US011384489B2

(12) United States Patent
Martinez

(10) Patent No.: US 11,384,489 B2
(45) Date of Patent: Jul. 12, 2022

(54) SCARIFIER SYSTEM, AND METHOD OF RESURFACING OR REMODELING A GROUND SURFACE USING THE SCARIFIER SYSTEM

(71) Applicant: Ariel Gerardo Martinez, Plantation, FL (US)

(72) Inventor: Ariel Gerardo Martinez, Plantation, FL (US)

( * ) Notice: Subject to any disclaimer, the term of this patent is extended or adjusted under 35 U.S.C. 154(b) by 0 days.

(21) Appl. No.: 16/903,428

(22) Filed: Jun. 17, 2020

(65) Prior Publication Data

US 2021/0115630 A1 Apr. 22, 2021

Related U.S. Application Data

(60) Provisional application No. 62/862,271, filed on Jun. 17, 2019.

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC . B28D 1/044; E01C 23/0933; E01C 23/0088; E01C 23/09; E01C 23/0946
See application file for complete search history.

(56) References Cited

U.S. PATENT DOCUMENTS 2,736,311 A * 2/1956 Coates ..... B28D 1/044 125/14
2,973,950 A 3/1961 Tucker
3,248,152 A 4/1966 Henderson et al.
3,554,606 A 1/1971 Mabey et al.
4,279,056 A 7/1981 Jacobson et al.
4,295,274 A 10/1981 Bricher et al.
4,456,303 A 6/1984 Due
4,552,122 A * 11/1985 Kelly ..... B23D 59/006 125/14
4,557,245 A * 12/1985 Bieri ..... B23D 59/025 125/14
5,176,426 A 1/1993 Adamson
5,445,437 A 8/1995 Adamson
(Continued)

FOREIGN PATENT DOCUMENTS

CA 2124250 A1 * 11/1995 ..... E01C 23/088

*Primary Examiner* — Carib A Oquendo
(74) *Attorney, Agent, or Firm* — John Rizvi; John Rizvi, P.A.—The Patent Professor®

(57) ABSTRACT

A scarifier system for cutting channels into a ground surface according to a chosen design pattern, comprising a scarifier machine, and a guide system for guiding the scarifier machine on a tracked trail. The guide system for guiding the scarifier machine on a tracked trail can be, for instance, a sliding bracket clasping a guide rail or a rolling carriage having one or more pairs of wheels gripping a guide rail. A method of remodeling a ground surface using the scarifier system comprises the steps of planning a design pattern to remodel the ground surface and to mark the ground surface according to the chosen design pattern. The guide rail is installed on the ground surface according to the chosen design pattern and the scarifier machine is placed on the guide rail in a manner that the scarifier machine can slide along the guide rail to cut a channel into the ground surface.

13 Claims, 8 Drawing Sheets

(56) References Cited

U.S. PATENT DOCUMENTS

| | | | | |
|---|---|---|---|---|
| 5,722,789 | A | 5/1998 | Murray et al. | |
| 5,775,781 | A | 7/1998 | Sawtelle et al. | |
| 6,135,567 | A | 10/2000 | Cochran | |
| 6,170,478 | B1 * | 1/2001 | Gorder | B23D 45/024 125/1 |
| 6,402,252 | B1 | 6/2002 | Dickson | |
| 6,663,476 | B1 * | 12/2003 | Story | B24B 19/004 451/347 |
| 6,794,007 | B2 | 9/2004 | Carr et al. | |
| 7,144,087 | B2 | 12/2006 | Haroldsen et al. | |
| 8,002,360 | B2 | 8/2011 | Cochran et al. | |
| 8,056,549 | B1 | 11/2011 | Fleetwood | |
| 8,740,311 | B2 | 6/2014 | Nagasawa | |
| 9,157,196 | B2 | 10/2015 | McSwain et al. | |
| 10,131,071 | B2 * | 11/2018 | Kaneider | B28D 1/045 |
| 2006/0169269 | A1 * | 8/2006 | Baratta | B28D 1/041 125/13.01 |
| 2007/0096539 | A1 | 5/2007 | Walker et al. | |
| 2007/0163566 | A1 | 7/2007 | Johnson et al. | |
| 2010/0154216 | A1 | 6/2010 | Hulen | |
| 2018/0119365 | A1 | 5/2018 | Velazquez | |
| 2018/0347124 | A1 | 12/2018 | Lorenz | |

* cited by examiner

SCARIFIER SYSTEM, AND METHOD OF RESURFACING OR REMODELING A GROUND SURFACE USING THE SCARIFIER SYSTEM

CROSS-REFERENCE TO RELATED APPLICATION

This application claims the benefit of U.S. Provisional Patent Application No. 62/862,271, filed on Jun. 17, 2019, which is incorporated by reference herein in its entirety.

FIELD OF THE INVENTION

The present invention relates generally to a scarifier systems, and more particularly, to a scarifier system for cutting channels into a ground surface according to a chosen design pattern, the scarifier system comprising a scarifier machine working in conjunction with at least one guiding element configured to guide the scarifier machine such that the machine advances in accordance with said chosen design pattern. The present invention also relates to a method of resurfacing or remodeling a ground surface according to a chosen design pattern using the scarifier system.

BACKGROUND OF THE INVENTION

Driveways are commonly used as roads leading to real estates from a public road. Such real estates may be, for instance, garages, carports, houses or buildings. An area of pavement in front of a garage with a curb cut in the sidewalk is also called a driveway. In some instances, driveways may be too small to accommodate a car, and yet still be called a driveway. In most cases, however, driveways are large enough to accommodate one or more vehicles.

Driveways often have a lighter traffic, or even have no vehicles parked during the way (e.g., during normal working hours). Because of this, many homeowners are willing to invest in the aesthetic construction of their property. Furthermore, driveways can be more easily decorated, in contrast to public roads. Driveways are usually not reground surfaced, snow blown or otherwise maintained by the local authorities.

Commercial property driveways, parking lots and other similar pavement areas are also susceptible to being decorated. This may enhance their aesthetical appeal and ability to attract consumers, as well as rendering the consuming experience overall more pleasant.

Materials used for driveways and pavement structures typically include asphalt, which is a form of petroleum mainly used for making asphalt concrete for paving road surfaces and driveway surfaces. Materials used for driveways and pavement structures may additionally or alternatively include concrete, which is a composite material usually composed of fine and coarse aggregate, wherein the aggregate is bonded together with a fluid cement. Concrete and asphalt need to harden over time. Driveways and pavement structures may additionally or alternatively include decorative brick, cobblestone, block paving, gravel, and decomposed granite. Any of the aforementioned materials may be surrounded with grass or other ground-covered plants.

Concrete can be cut by a concrete saw. This power tool can also be used for cutting masonry, brick, asphalt, tile, and other solid materials used in driveways. Concrete saws are usually powered by gasoline, hydraulic or pneumatic pressure, or an electric motor. Concrete saws often comprise a saw blade, which can be a diamond saw blade to cut the concrete, asphalt, stone, etc. The significant friction generated in cutting hard substances like concrete usually requires the blades to be cooled to prolong their lite and reduce dust. The concrete saw may also comprise cut-off wheels, which are optionally abrasive to be used on cut-off saws.

The choice of the saw blade should be matched between the saw blade's features and the concrete/asphalt's type. Some concretes are reinforced and have steel bars in them. Some concretes' stone aggregate is pebbles and some is crushed rocks. Cured concretes' curing time is long and green concretes' is short. The saw blades should have different design to fit these concrete or asphalt.

Another type of concrete-cutting machine is known as a scarifier, surface planer or milling machine. A scarifier is typically a wheeled apparatus comprising several concrete-cutting blades that rotate at high speeds in order to erode or scar a concrete, asphalt or other hard surface as the apparatus rollingly moves on and along the hard surface.

Concrete saws and scarifiers usually possess a heavy weight. Therefore, the person using these devices for cutting concrete may have difficulties to cut straight channels in the concrete. This is specially the case when the concrete is reinforced and has steel bars or the concretes' stone aggregate is pebbles or crushed rocks. Thus, a person will have difficulties to cut channels in the concrete according to a chosen design pattern.

Accordingly, there is an established need for a concrete-cutting system which allows to cut a concrete, asphalt or other hard surface according to a chosen design pattern.

SUMMARY OF THE INVENTION

The present invention is directed to a scarifier or concrete-cutting system for cutting channels into a concrete, asphalt or other hard ground or surface according to a chosen design pattern. The scarifier system comprises a scarifier machine and a guide system for guiding the scarifier machine on a tracked trail. The means for guiding the scarifier machine on a tracked trail can include one or more guide rail receivers mounted on a guide rail and configured to slide or roll on, and along, the guide rail.

Introducing a first embodiment of the invention, the present invention consists of a scarifier system for cutting channels into a ground surface according to a chosen design pattern. The scarifier system comprises a scarifier machine and a guide system for guiding the scarifier machine on a tracked trail.

In a second aspect, the guide system may include one or more guide rails.

In another aspect, the one or more guide rails may be configured to be secured to the ground surface.

In another aspect, at least one guide rail of the one or more guide rails may be at least partially straight.

In another aspect, at least one guide rail of the one or more guide rails may be at least partially curved.

In yet another aspect, the scarifier system may include at least one guide rail receiver carried by the scarifier machine and configured to engage with and move along a guide rail of the one or more guide rails.

In another aspect, the at least one guide rail receiver may comprise at least one sliding bracket configured to slide on the guide rail.

In another aspect, the sliding bracket may have an inverted-U-shape.

In another aspect, the at least one guide rail receiver may include at least one roller configured to engage with and roll along the guide rail.

In yet another aspect, the at least one guide rail receiver may be connected to the scarifier machine by a support arm, wherein the at least one guide rail receiver is supported in a spaced apart relationship with the scarifier machine by the support arm.

In another aspect, at least one guide rail of the one or more guide rails may be elongate and include a first portion and a second portion arranged at an angle such that the guide rail has an L-shaped transverse cross-section. The first portion of the at least one guide rail may be attachable to the ground surface and the second portion of the at least one guide rail may be configured to rise from the ground surface when the first portion is attached to the ground surface.

In another aspect, the second portion of the guide rail may be perpendicular to the first portion of the guide rail.

In another aspect, the second portion of the guide rail can be arranged at an angle other than 90 degrees relative to the first portion of the guide rail.

In yet another aspect, the at least one guide rail receiver may be configured to engage with a top of the second portion of the guide rail.

In another aspect, the scarifier machine of the scarifier system may comprise at least one pair of wheels providing the scarifier machine with rolling mobility relative to the ground surface.

In another aspect, the scarifier system may be configured to adopt an assembled configuration in which the at least one guide rail receiver engages with a guide rail of the one or more guide rails such that the at least one guide rail receiver is movable along the guide rail and while the at least one pair of wheels roll on the ground surface.

In another aspect, the scarifier system may further include an electrified member including at least one of an overhead electrical power line and an electrified rail attached to the ground surface, the electrified member configured to provide electrical power to the scarifier machine.

In yet another aspect, at least one of the guide rails may be equipped with an electrification system inside one of the at least one guide rail.

In another aspect, at least one of the guide rails may be equipped with an electrification system comprising an overhead electrical power line or an additional electrified rail.

In another aspect, at least one of the wheels of the scarifier machine may be conical and the at least one guide rail may be sloped by the same amount to follow curves better.

In another aspect, at least one of the wheels of the scarifier machine may be cylindrical and the at least one guide rail may be vertical.

In yet another aspect, at least one of the guide rails may be attached to the ground surface by a hooked spike or a screw spike.

Introducing another aspect of the invention, the present invention consists of a method for residential and commercial remodeling, in particular resurfacing or remodeling of ground surfaces, such as driveways, backyards, warehouses, patios, clubs and hotels.

A first step of the method can include repairing and cleaning the ground surface if needed. A second step can include planning a design pattern to remodel the ground surface and to mark the ground surface according to the chosen design pattern of the ground surface to be remodeled. A third step may include installing at least one guide rail on the ground surface according to the chosen design pattern of the ground surface to be remodeled. The at least one guide rail can be installed on the ground surface by bolts, for instance and without limitation. The fourth step comprises placing a scarifier machine, having at least one guide rail receiver, on at least one guide rail such that the at least one guide rail receiver couples to the guide rail in a manner that the guide rail receiver can move along and be guided by the guide rail. In case the guide rail receiver of the scarifier machine comprises at least one sliding bracket, the sliding bracket can be placed on top of the guide rail. In case the guide rail receiver of the scarifier machine comprises at least one rolling carriage having at least one pair of wheels, the at least one pair of wheels grips the guide rail in a manner that the wheels roll along the guide rail to make it possible for the scarifier machine to be guided along the guide rail. Upon starting the engine of the scarifier machine, the cutting wheels start to turn and cut the ground surface. Guided by the coupling between the at least one guide rail receiver and the at least one guide rail, the scarifier machine advances along the at least one guide rail and cuts a channel into the ground surface. The fifth step comprises removing the at least one guide rail after a set of channels in accordance with the design pattern is obtained. The sixth step comprises cleaning the residual concrete from the ground surface if needed. The seventh step comprises painting the ground surface if needed. The eight step comprises applying glue or another adhesive inside the channels to add artificial grass or any other decorative material. The ninth step comprises adding artificial grass or other decorative material in the channels.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a scarifier system for cutting channels into a concrete, asphalt or other hard surface or ground according to a chosen design pattern, the scarifier system comprising a scarifier machine and a guide system for guiding the scarifier machine along a desired direction or path.

Figure 1:
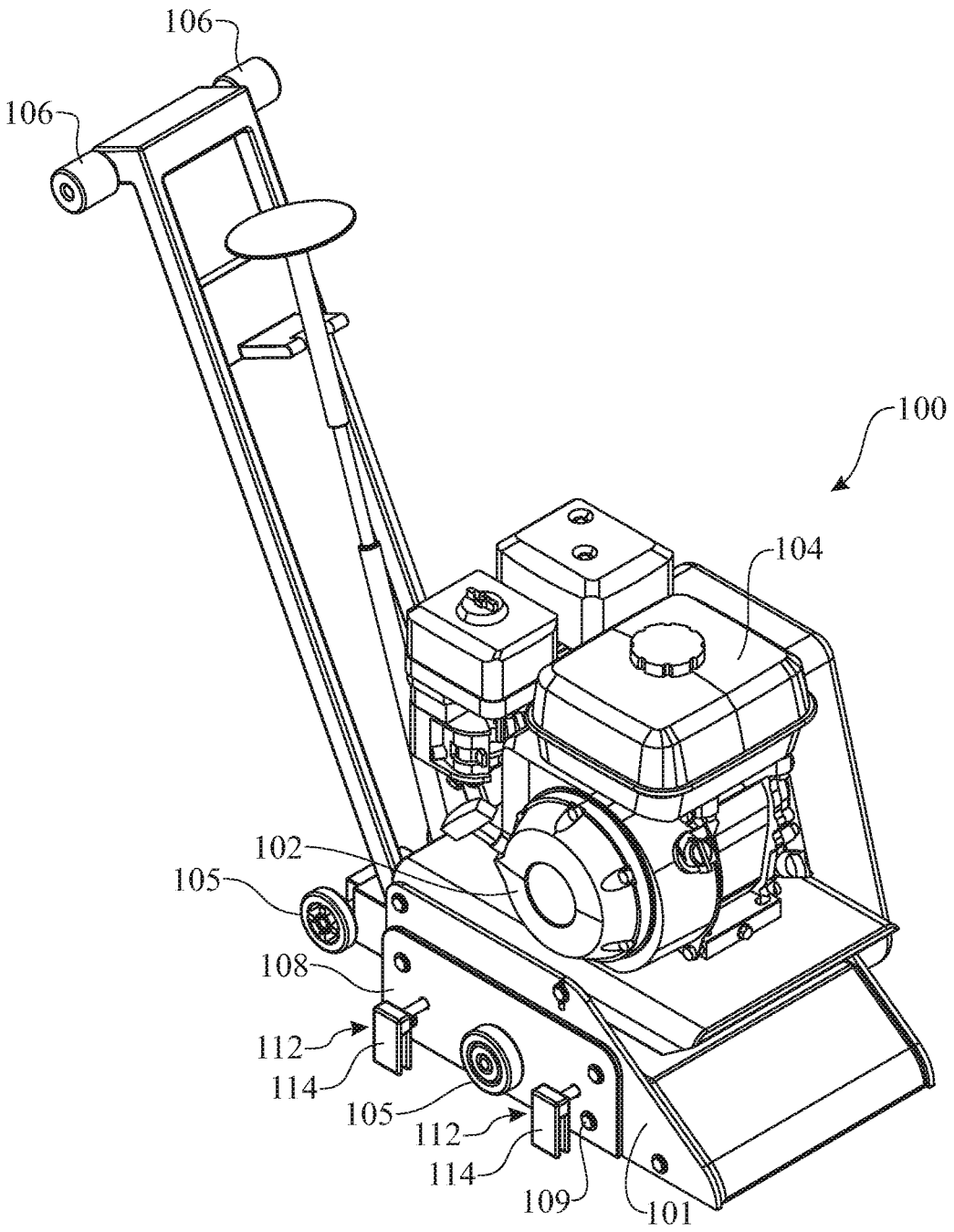
FIG. 1 presents a top front isometric view of a scarifier machine according to an embodiment of the present invention.

Referring initially to FIG. 1, a top front isometric view of a concrete-cutting machine or scarifier machine 100 (hereinafter referred to generically as scarifier machine 100) according to an illustrative embodiment of the present invention is presented. It must be noted that, while a scarifier machine is shown, alternative concrete/asphalt-cutting machines can be used in lieu of the scarifier machine without departing from the scope of the present disclosure. In addition, throughout the present description, unless expressed otherwise, the term 'concrete' may be used generically for clarity purposes, in which case said term shall be understood to encompass concrete, asphalt, cement or any other hard material or combination of materials used to construct driveways, pavements, roads, floors, grounds or the like.

Figure 5:
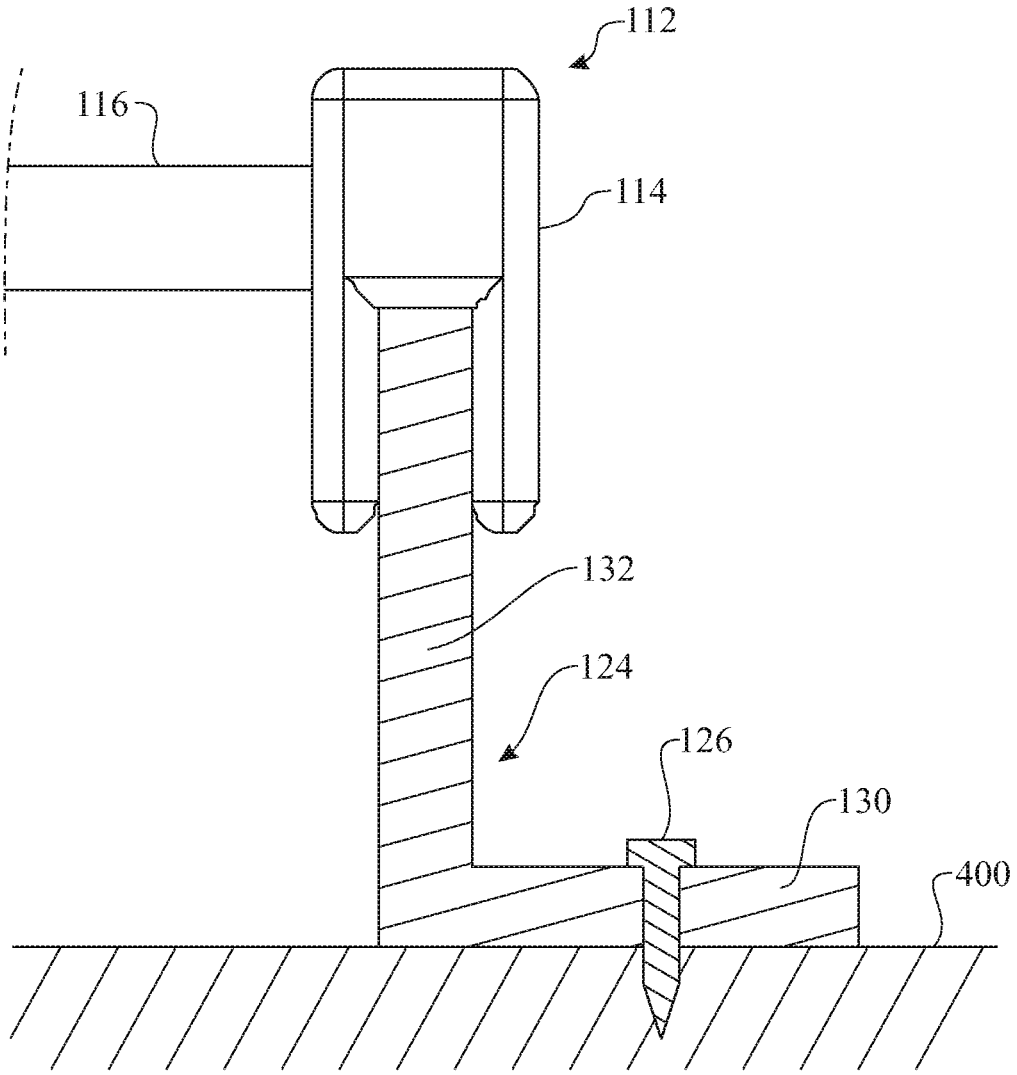
FIG. 5 presents a cross-sectional side elevation view of a sliding bracket of the scarifier machine of FIG. 1 on a guide rail.

The scarifier machine 100 depicted herein as an illustrative, non-limiting example of the invention is compact and comprises an engine 102, which can be, for instance and without limitation a HONDA 9 HP 270 cc gas engine. Furthermore, the scarifier machine 100 comprises a fuel tank 104 for storing the fuel for powering the engine 102. The fuel tank 104 of the present embodiment is placed above the engine 102. In addition, the scarifier machine 100 comprises a set of wheels 105 providing rolling mobility to the scarifier machine 100, and two handles 106 for an easy pushing and/or pulling of the scarifier machine 100 by a person in order to roll the scarifier machine 100 along a ground or surface 400 (FIG. 5).

Figure 2:
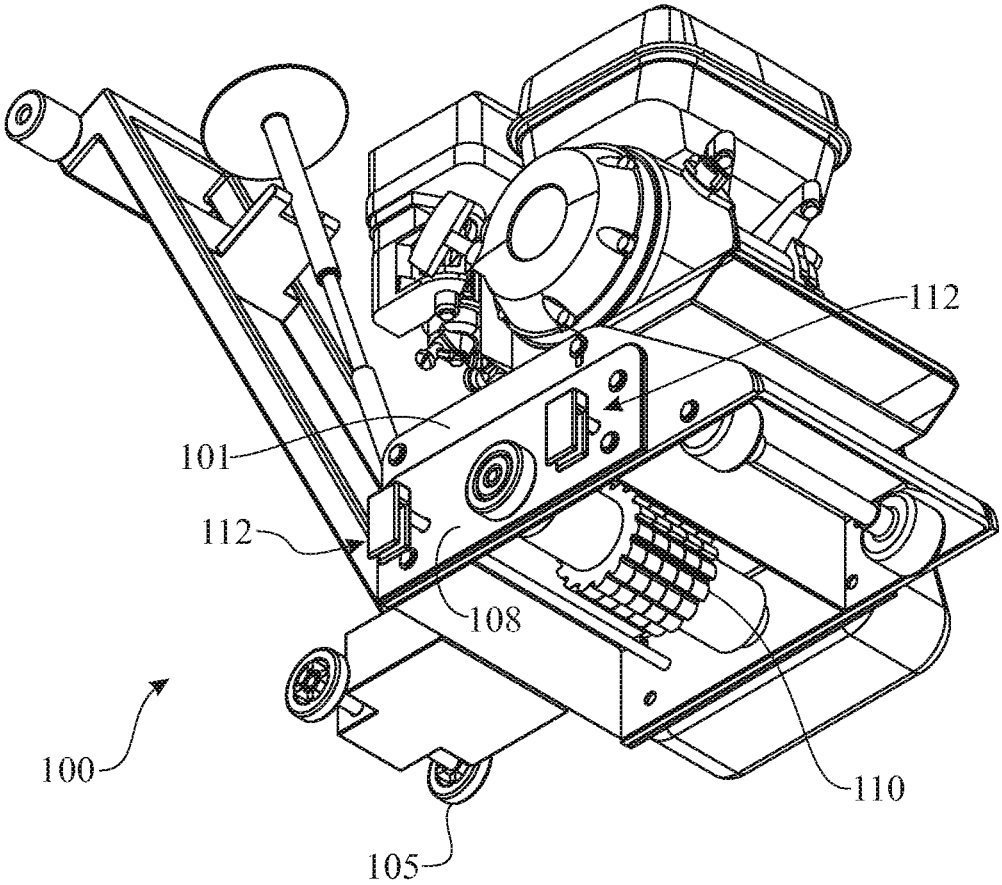
FIG. 2 presents a bottom front isometric view of the scarifier machine of FIG. 1.

As shown in the bottom view of FIG. 2, the scarifier machine 100 further comprises a cutting wheel 110 configured to erode, cut, grind or mill a concrete surface (e.g., surface 400) which lies underneath the scarifier machine 100. In different embodiments of the invention, the size and shape of the cutting wheel 110 may vary, such as in dependence of the desired width or depth to be cut into the surface 400. For example, the cutting wheel 110 may consist in a 4-inch diamond cutting wheel to produce or cut a 4-inch wide channel or groove into the concrete surface 400. The cutting wheel 110 of the present embodiment is powered by the engine 102. It must be noted that, alternatively or additionally to having the cutting wheel actuated by a fuel-powered engine, the scarifier machine may include an electric motor, pneumatic actuator, hydraulic actuator and/or other actuator configured to impart rotational energy to the cutting wheel.

Referring again to FIG. 1, the scarifier machine 100 further comprises at least one guide rail receiver 112 configured to participate in guiding the scarifier machine 100 as will be described in detail hereinafter. For instance, the present scarifier machine 100 specifically includes two guide rail receivers 112. The guide rail receiver(s) 112 can be provided on one or more sides of the scarifier machine 100. For instance, the present embodiment includes guide rail receivers 112 on a single side of the scarifier machine 100 (the right-hand side, as shown). In different embodiments, the one or more guide rail receivers 112 may extend outward from a chassis of scarifier machine or other parts of the machine. For instance, the guide rail receivers 112 depicted herein are carried by a plate 108 which in turn is attached to a body or chassis 101 of the scarifier machine 100, such as by bolts 109; this configuration allows, for instance, to adapt existing or conventional scarifier machines in order to provide the method and system of the present disclosure. The plate 108 can present any applicable shape that is best suited for the surface of the scarifier machine on which it is to be attached; for instance, the plate 108 of the present embodiment is generally rectangular, which allows for a simple construction and yet a relatively large surface area, increasing robustness of the plate 108 and the plate-chassis connection. The plate 108 may have rounded edges.

Figure 3:
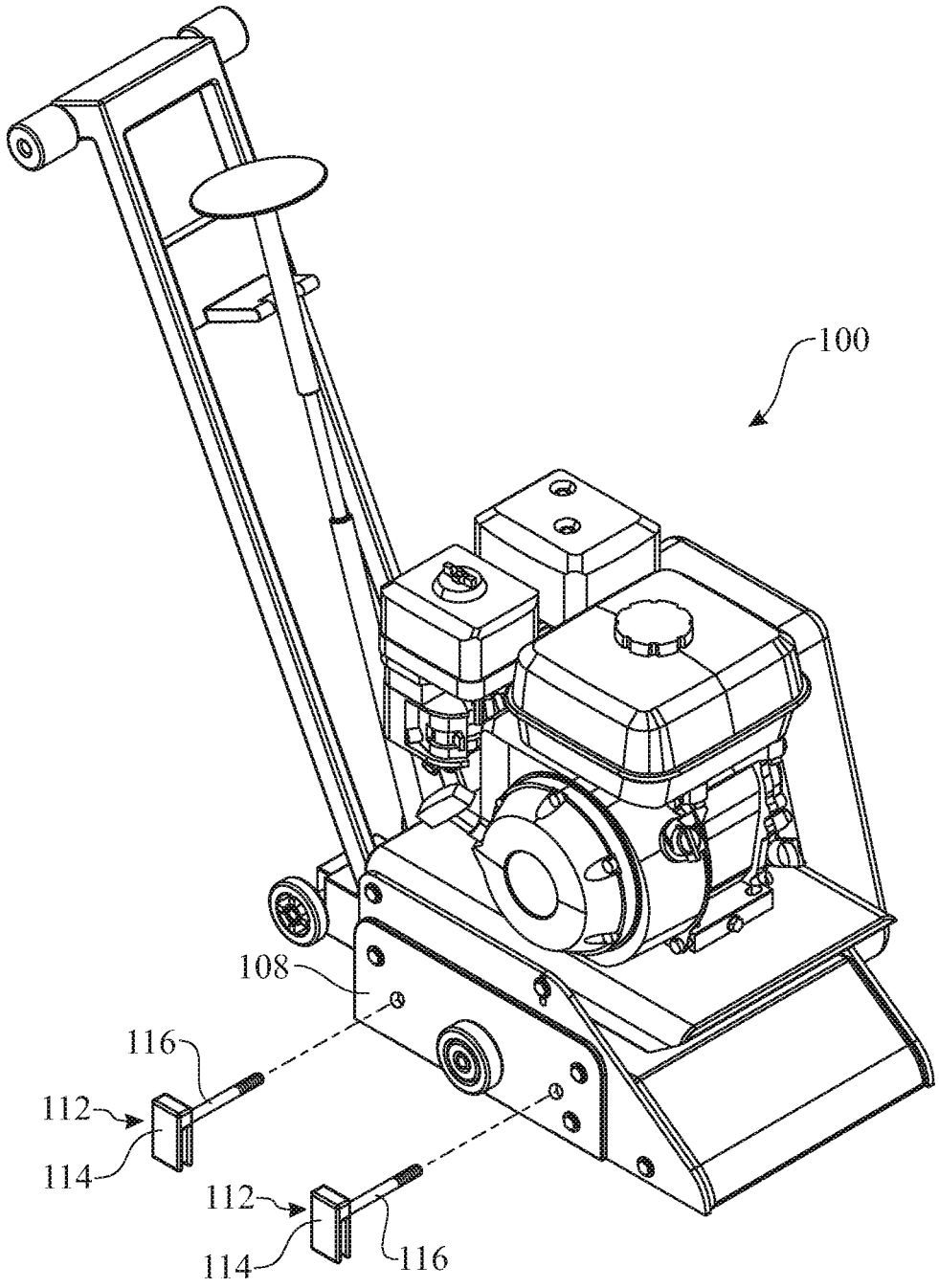
FIG. 3 presents an exploded top front view of the scarifier machine of FIG. 1.

In different implementations of the invention, the guide rail receiver(s) can be non-removably attached to the plate 108 or other part of the scarifier machine 100 (e.g., integrally-formed with the chassis 101) or removably attached to the plate 108 or other part of the scarifier machine 100. For instance, as shown in FIG. 3, the guide rail receivers 112 of the present embodiment are disconnectably connected to the plate 108. Each of the guide rail receivers 112 comprises a supporting arm 116, which can extend from the plate 108 in a manner that the supporting arm 116 is arranged perpendicular to the plate 108. In some embodiments, the supporting arm 116 can be disconnectably attached to the plate 108 or other part of the scarifier machine 100; for example, the supporting arms 116 of the present embodiment are threaded to the plate 108. A screwable or otherwise disconnectable guide rail receiver 112 makes it possible to attach guide rail receivers of different shape and size to the plate 108. For example guide rail receivers 112 having supporting arms 116 of different length may be screwed to the plate 108 in order to fit the guide rail receivers 112 to guide rails with different spacing relative to the cutting wheel 110 of the scarifier machine 100.

As shown in FIG. 5, the guide rail receiver 112 of the present embodiment is formed comprising a rigid, inverted U-shaped sliding bracket 114 and the aforementioned supporting arm 116, wherein the sliding bracket 114 is carried by the supporting arm 116. The sliding bracket 114 is configured to rests on and clasp, or engage with, a top of a second portion 132 of a guide rail 124 as will be described in greater detail hereinafter. The supporting arm 116 extends from an inner a side of the sliding bracket 114 to the plate 108 on the scarifier machine 100 such that the sliding bracket 114 and plate 108 are maintained in a spaced-apart relationship by the supporting arm 116.

Figure 4:
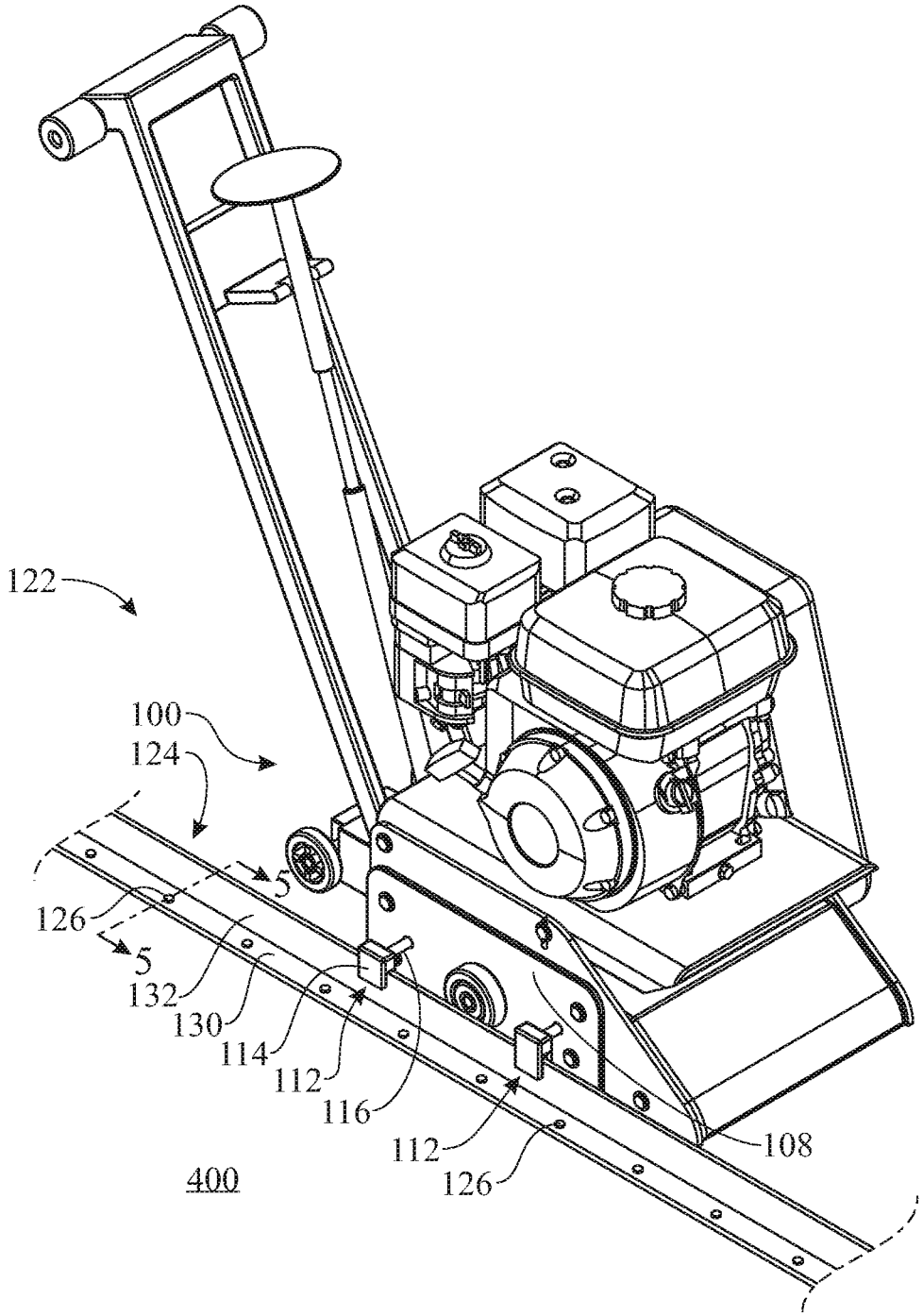
FIG. 4 presents a top front isometric view of a scarifier system according to an embodiment of the present invention.

Turning to FIG. 4, a top front isometric view of a scarifier system 122 according to an embodiment of the present invention is presented. The scarifier system 122 comprises the scarifier machine 100 of FIGS. 1-3 and a guide rail 124 arranged on a side (e.g., the right-hand side) of the scarifier machine 100. The guide rail 124 is removably mounted on the ground surface 400 by bolts 126. The scarifier machine 100 is placed on the guide rail 124 in a manner that the sliding brackets 114 of the guide rail receivers 112 fit onto or engage with the guide rail 124 in such a way that the sliding brackets 114 are slidable along the guide rail 124. The sliding coupling between the guide rail 124, which is fixed to the ground surface 400, and the sliding brackets 114, which are fixed to or carried by the scarifier machine 100, make it possible for the scarifier machine 100 to slide along the guide rails 124 and be guided along the ground surface by the guide rails 124. As a consequence of such guiding, the cutting wheels 110 of the scarifier machine 100 can cut perfectly straight or curved lines as defined by the shape of the guide rail 124. For example, the guide rail 124 shown in FIG. 4 is straight and allows the cutting wheels 110 to cut a perfectly straight channel as the scarifier machine 100 advances guided by the guide rail 124.

As further shown in FIG. 5, the guide rail 124 can be an elongate body comprising a first portion 130 and a second portion 132 extending at an angle with one another such that the elongate body has an L-shaped transverse cross-section, as shown. The first portion 130 of the guide rail 124 is placed flatly on the concrete ground surface 400 and screwed to the ground surface 400 by the aforementioned bolts 126. The second portion 132 of the guide rail 124, in turn, rises from the ground surface 400, for instance perpendicularly to the first portion 130, as shown. However, alternative embodiments are contemplated in which the second portion 132 is not perpendicular to the first portion 130 so that when the first portion 130 is rested on a sloped ground surface 400, the second portion 132 can rise vertically. In some embodiments, such as the present embodiment, the first and second portions 130 and 132 are integrally-formed into a single-piece unit. In other embodiments, the first and second portions 130 and 132 of the guide rail 124 can be adjustable relative to one another such that a user can select the angle formed between them and thus customize the guide rail 124 in accordance with the specific slope of different ground surfaces 124 such that the first portion 130 can rest on the sloped ground surface 400 while the second portion 132 can rise vertically. For example, the first and second portions 130 and 132 of the guide rail 124 can be pivotably connected to one another and selectively lockable to different angles relative to one another as desired by the user in dependence of the slope of the ground surface 400.

In further embodiments, the wheels of the scarifier machine may be conical and the guide rails may be sloped by the same amount to assist in following curves formed in the guide rail. In other embodiments, the wheels of the scarifier machine may be cylindrical and the guide rails of the tracked trail may be vertical.

Figure 6:
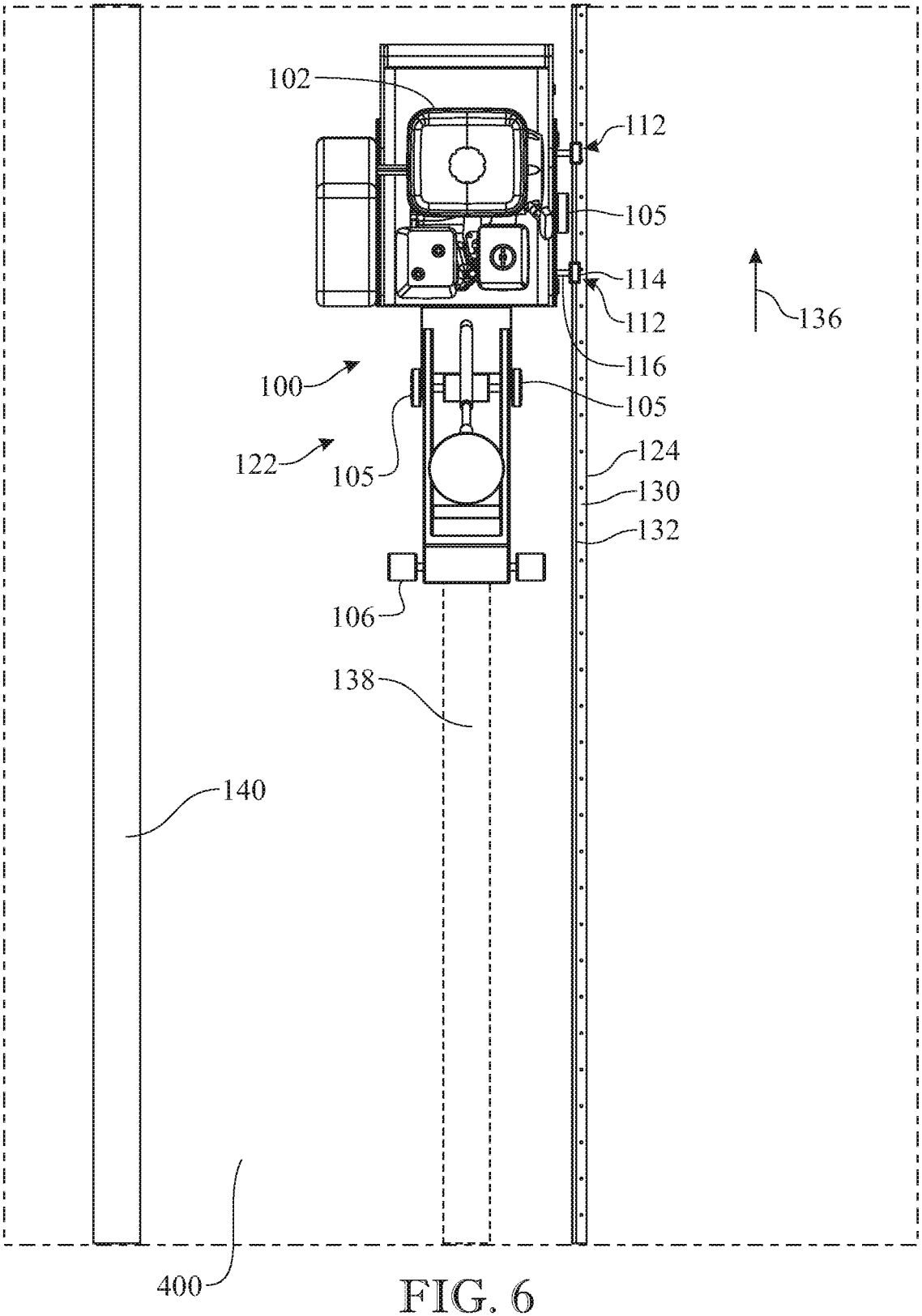
FIG. 6 presents a top isometric view of the scarifier system of FIG. 4.

The illustration of FIG. 6 shows a top plan view of the scarifier system 122 of FIG. 4, comprising the scarifier machine 100 and the straight guide rail 124, with the scarifier system 122 shown in operation. As can be seen, when the engine 102 of the scarifier machine 100 is turned on, the cutting wheels 110 (see FIG. 2) start to rotate and scarify the ground surface 400. With the engine 102 running, a user (not shown) grasps the handle 106 and pushes the scarifier machine 100 forward (or, alternatively, the scarifier machine 100 may be self-propelled to advance forward without requiring an external pushing force). As the scarifier machine 100 advances forward, the scarifier machine 100 is guided by the guide rail 124 engagement with the guide rail receivers 112, to cause the scarifier machine 100 to advance in a guide direction 136 defined by—and following the shape of—the guide rail 124, and the cutting wheels 110 cut a channel 138 in the ground surface 400 also shaped as the guide rail 124. Once the channel 138 is formed, the guide rail 124 can be disconnected and removed from the ground surface 400. The process can be repeated to form additional channels by mounting the guide rail 124 in separate locations and once more running the scarifier machine 100 along the guide rail 124. For instance, the drawing of FIG. 6 shows a second channel 140 formed in parallel relationship with channel 138; the second channel 140 has been formed by mounting the guide rail 124 in a second location, parallel and spaced apart from the current location of the guide rail 124 shown in the figure. The channel(s) 138, 140 that are cut into the concrete ground surface 400 can optionally be filled with decorative items such as artificial grass, real grass, stones, pebbles, gravel, or combinations thereof, for instance and without limitation, which can provide an aesthetically pleasing contrast and visual finish to the surrounding concrete. The decorative items can be adhered inside the channel(s), such as to a channel floor and/or sidewalk, by an adhesive material such as, but not limited to, cement, silicone, or glue.

Figure 7:
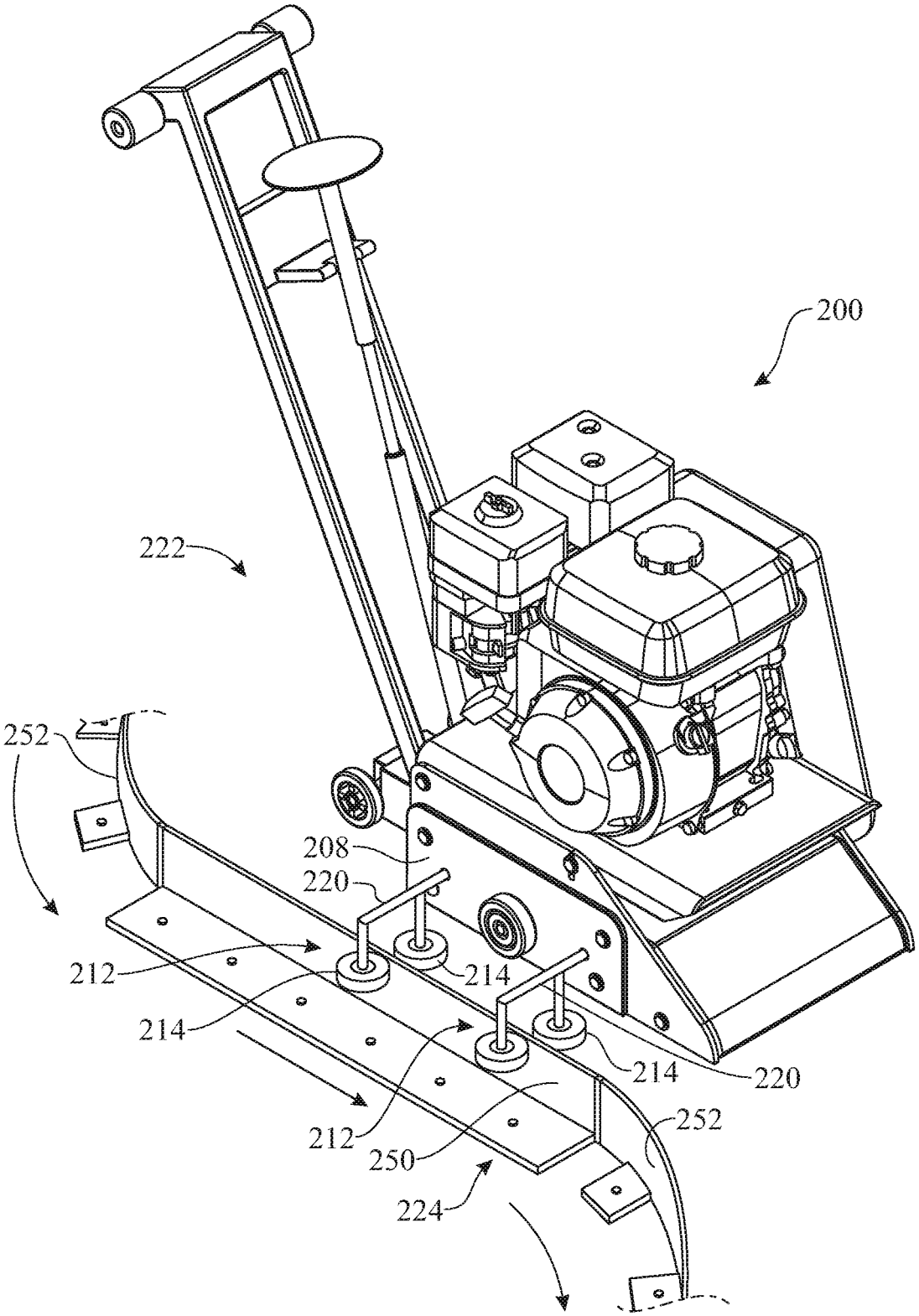
FIG. 7 presents a top front isometric view of a scarifier system with pairs of wheels.

The illustration of FIG. 7 presents a scarifier system 222 according to a second illustrative embodiment of the present invention, the scarifier system 222 comprising a scarifier machine 200 and a guide rail 224. Like features of the scarifier system 222, scarifier machine 200 and guide rail 224 are numbered the same as those of the previously-described scarifier system 122, scarifier machine 100 and guide rail 124, except preceded by the numeral '2'. Similarly to the previous embodiment, the scarifier machine 200 carries a set of one or more guide rail receivers 212 arranged in spaced-apart relationship with a side of the scarifier machine 200, such as by having the guide rail receivers 212 carried by supporting arms 220 which extend from a plate 208 that is secured to the side of the scarifier machine 200. However, unlike the previous embodiment, each guide rail receiver 212 of the present embodiment is formed as a rolling carriage or rolling element such as, but not limited to, one or more pairs of rollers or wheels 214 configured to engage with, and roll along, the guide rail 224. In the present embodiment, more specifically, each of the two supporting arms 220 extending from the plate 208 carries a pair of wheels 214 configured to receive the guide rail 224 therebetween, i.e. with each wheel 212 gripping the guide rail 224 at an opposite side thereof. Once the wheels 214 are mounted on the guide rail 224, the wheels 214 can roll on the guide rail 224 when the scarifier machine 200 is pushed or self-propelled forward. Similarly to the previous embodiment, the coupling between the wheels 214 and the guide rail 224 allow the scarifier machine 200 to be guided by, and along, the guide rail 224.

As can be further seen in the drawing, the guide rail 224 shown in the second illustrative scarifier system 200 comprises a straight part 250 and two curved parts 252. In some embodiments, the parts 250, 252 of the guide rail 224 can be integrally-formed into a single-piece unit. In other embodiments, the parts 250, 252 may be non-integrally formed and may be joined, for instance and without limitation, by a simple fishplate or a metal bar bolted through the web of the parts of the guide rail 224.

It is to be noted that the different embodiments of the scarifier machine 100, 200 depicted herein and/or described heretofore can be used in combination with an entirely-straight guide rail (e.g., guide rail 124), an entirely-curved guide rail, a partially-straight guide rail (e.g., guide rail 224), a partially-curved guide rail (e.g., guide rail 224), or other guide rail shape. For example, the guide rail 224 of FIG. 7 can be used with the scarifier machine 100 of HG. 1, and the guide rail 124 of FIG. 4 can be used with the scarifier machine 200 of FIG. 7.

Alternatively or additionally to the rolling carriages or rolling guide rail receivers 212 (FIG. 7) and the sliding guide rail receivers 112 (FIG. 1-6), the scarifier machine may comprise other guide systems for guiding the scarifier machine along the guide rail. For example, the scarifier machine may comprise one or two metal wheel(s) for running on one guide rail or the scarifier machine may comprise two or four metal wheels for running on one or two guide rail(s). In further embodiments of the invention, the scarifier machine may include electronic guiding means such as geolocation system configured to obtain the instant position of the scarifier machine, direction of displacement, speed and/or other physical magnitude characterizing the movement of the scarifier machine, compare said movement to a predefined (and user-configurable) pattern stored locally on the scarifier machine, or remotely and accessible by the scarifier machine over a computer network (e.g., the Internet), and readjusting the movement of the scarifier machine (e.g., rotating the scarifier machine wheels) to follow the predefined pattern and scarify a channel according to said predefined pattern.

In some embodiments, the guide rails may be equipped with an electrification system inside one of the guide rails or an overhead electrical power line, to power the scarifier machine alternatively or additionally to the aforementioned fuel-powered engine or other actuator comprised in the scarifier machine. Alternatively or additionally, an additional rail may provide electric power to the scarifier machine; the additional rail may be formed, for instance, as a semi-continuous rigid conductor placed alongside the guide rail. The electrification system may supply a direct or alternate current electricity.

In some embodiments, the guide rails may be made of hot rolled steel with a cross section approximate to an asymmetric I-beam, optionally with a bullhead section carried in cast iron chairs. Alternatively, the guide rail may be designed as a flat-bottom rail optionally comprising steel. The guide rail may be formed as a grooved rail, groove rail, or girder rail. Alternatively, the guide rail may be formed as bullhead rail, or a double-headed rail, which may be turned over and re-used when the head becomes worn. Alternatively, the guide rail may be formed as a wrought iron rail with cast iron chairs upon stone blocks. Furthermore, the guide rail may be designed as a flanged T-rail or an iron-strapped wooden rail, Barlow rail, bridge rail, plate rail, strap rail or a thin iron strap laid on top of the timber rail. The guide rail may be fastened to the ground surface by dog spikes or by a hooked spike or a screw spike, for instance and without limitation.

Figure 8:
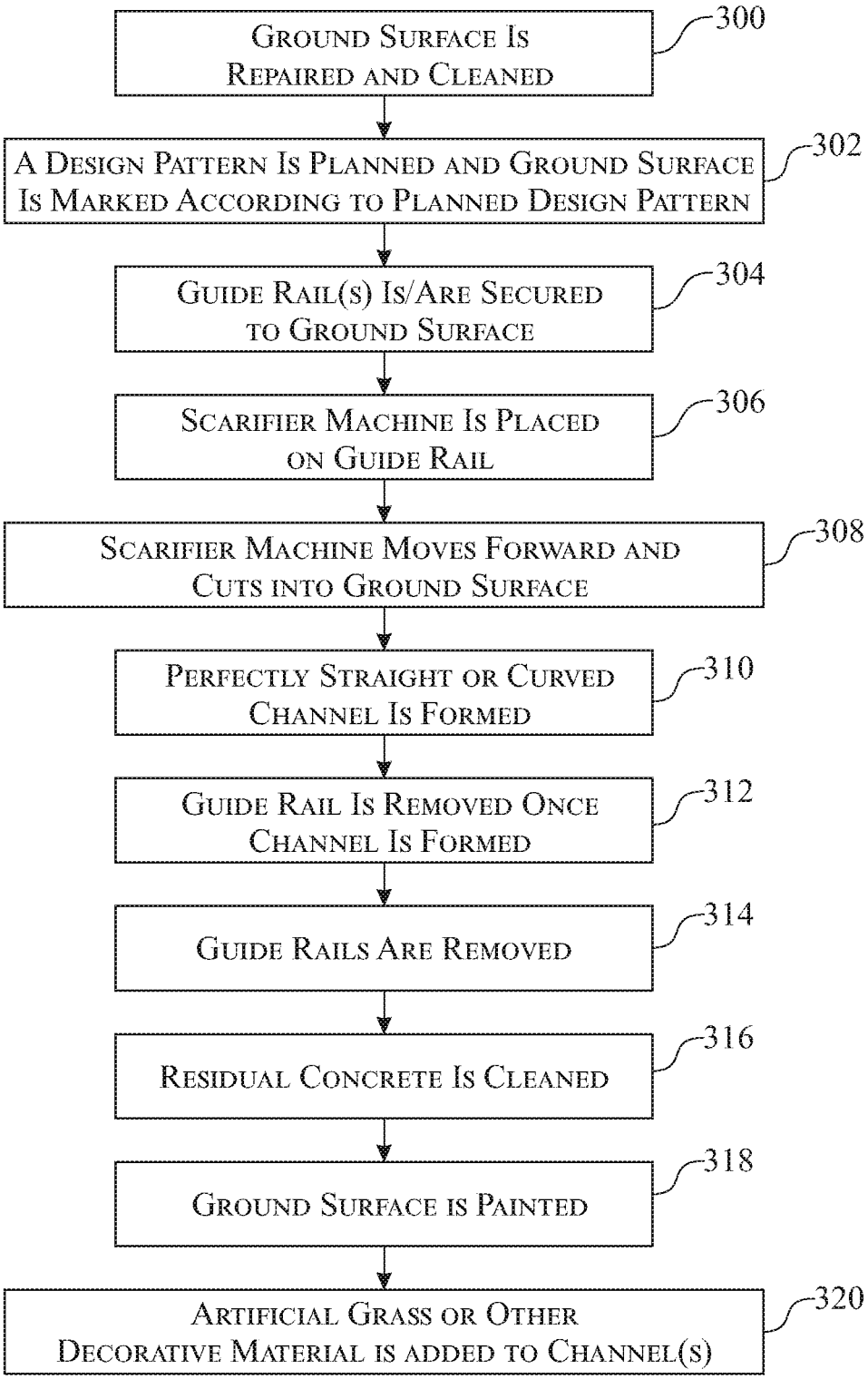
FIG. 8 presents a method of cutting channels into a concrete of a driveway using the scarifier system.

Turning to FIG. 8, a method of cutting channels into a concrete driveway, pavement, road, floor, or surface (hereinafter referred to generically as driveway) using the scarifier system described heretofore is presented. The method comprises a series of steps that will be hereinafter described. The first step 300 of the method may include repairing and cleaning the ground surface of the driveway if needed. The second step 302 includes planning a design pattern to remodel the surface of the driveway and to mark the ground surface of the driveway according to a chosen design pattern of the ground surface to be remodeled. The third step 304 includes securing at least one guide rail on the ground surface of the driveway according to the chosen design pattern of the surface to be remodeled. The guide rail or rails can be installed on the ground surface by bolts (see FIG. 5), for instance and without limitation. The fourth step 306 comprises placing the scarifier machine on a guide rail such that one or more guide rail receivers provided in the scarifier machine engage with the guide rail in a manner that the scarifier machine can slide or roll along the guide rail. In case the guide rail receiver or receivers of the scarifier machine comprises guide rail receivers, the brackets can be saddled on the guide rails (see FIG. 5). In case the guide rail receiver or receivers of the scarifier machine comprise at least one rolling carriage having one or more pairs of wheels, each rolling carriage grips the guide rail in a manner that the wheels roll along the guide rail and the scarifier machine is thereby guided along the guide rail (see FIG. 6). Upon starting the engine of the scarifier machine, the cutting wheels of the scarifier machine start to turn and cut the ground surface of the driveway. The fifth step 308 comprises moving the scarifier machine forward along the guide rails while cutting a channel into the concrete or asphalt of the driveway from its ground surface (see FIG. 6). The sixth step 310 comprises continuing the fifth step 308 until a perfectly-formed, straight or curved channel is formed according to the design pattern defined by the guide rail. The seventh step 312 comprises removing the guide rail once the channel according to the design pattern is formed or completed. The eighth step 314 comprises removing all guide rails (if more than one guide rail us used) after the complete design pattern is obtained by repeating steps 306-310 to form more than one channel. The ninth step 316 comprises cleaning the residual concrete remaining on the ground surface of the driveway if needed. The tenth step 318 comprises painting the ground surface of the driveway if needed. The tenth step 318 comprises applying an adhesive (examples mentioned heretofore) inside the channel or channels to add artificial grass or any other decorative material. The eleventh step 320 comprises adding artificial grass or any other decorative material to the channels.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A scarifier system for cutting channels into a ground surface according to a chosen design pattern, the scarifier system comprising:

a scarifier machine operable to travel along a ground surface and to cut into said ground surface;

a guide system for guiding the scarifier machine on a tracked trail along said ground surface, the guide system comprising one or more guide rails, each guide rail comprising a first portion attachable to said ground surface and a second portion arranged at an angle with the first portion such that said each guide rail has an L-shaped transverse cross-section; and at least one guide rail receiver carried by the scarifier machine, wherein each guide rail receiver comprises a first roller and a second roller arranged in spaced-apart relationship with one another; wherein the scarifier system is configured to adopt an assembled configuration in which the first portion of one guide rail of the one or more guide rails is attached to the ground surface, and the second portion of said one guide rail is arranged rising from the ground surface, and further wherein the first and second rollers of each guide rail receiver are arranged on opposite side surfaces of the second portion of said one guide rail and are rollingly movable on said opposite side surfaces and along said one guide rail responsively to the scarifier machine being operated to travel along the ground surface, without said each guide rail receiver being supported on said one guide rail, and further wherein the first and second rollers of said each guide rail receiver are free to adjust their vertical position relative to the second portion of said one guide rail both upward and downward.

2. The scarifier system of claim 1, wherein at least one guide rail of the one or more guide rails is at least partially straight.

3. The scarifier system of claim 1, wherein at least one guide rail of the one or more guide rails is at least partially curved.

4. The scarifier system of claim 1, wherein each guide rail receiver of the at least one guide rail receiver is connected to the scarifier machine by a respective support arm, wherein the first and second rollers of said each guide rail receiver are supported in a spaced apart relationship with the scarifier machine by the support arm.

5. The scarifier system of claim 4, further comprising a plate attached to the scarifier machine, wherein each respective support arm is affixed to the plate.

6. The scarifier system of claim 5, wherein the plate is bolted to the scarifier machine.

7. The scarifier system of claim 1, wherein the second portion of said each guide rail is perpendicular to the first portion of said each guide rail.

8. The scarifier system of claim 1, wherein the second portion of said each guide rail is arranged at an angle other than 90 degrees relative to the first portion of said each guide rail.

9. The scarifier system of claim 1, wherein at least one guide rail of the one or more guide rails is configured to conduct electricity and power the scarifier machine.

10. The scarifier system of claim 1, further comprising an electrified member including at least one of an overhead electrical power line and an electrified rail attached to the ground surface, the electrified member configured to provide electrical power to the scarifier machine.

11. The scarifier system of claim 1, wherein the scarifier machine comprises at least one pair of wheels providing the scarifier machine with rolling mobility relative to the ground surface.

12. A scarifier system for cutting channels into a ground surface according to a chosen design pattern, the scarifier system comprising:

a scarifier machine operable to travel along a ground surface and to cut into said ground surface, the scarifier machine comprising at least one pair of wheels providing the scarifier machine with rolling mobility relative to the ground surface;

a guide system for guiding the scarifier machine on a tracked trail along said ground surface, the guide system comprising one or more guide rails, each guide rail comprising a first portion attachable to said ground surface and a second portion arranged at an angle with the first portion such that said each guide rail has an L-shaped transverse cross-section; and at least one guide rail receiver carried by the scarifier machine, wherein each guide rail receiver comprises a first roller and a second roller arranged in spaced-apart relationship with one another; wherein the scarifier system is configured to adopt an assembled configuration in which the first portion of one guide rail of the one or more guide rails is attached to the ground surface, and the second portion of said one guide rail is arranged rising from the ground surface, and further wherein the first and second rollers of each guide rail receiver are arranged on opposite side surfaces of the second portion of said one guide rail and are rollingly movable on said opposite side surfaces and along said one guide rail responsively to the scarifier machine being operated to travel along the ground surface, without said each guide rail receiver being supported on said one guide rail, and further wherein the first and second rollers of said each guide rail receiver are free to adjust their vertical position relative to the second portion of said one guide rail both upward and downward.

13. A scarifier system for cutting channels into a ground surface according to a chosen design pattern, the scarifier system comprising:

a scarifier machine operable to travel along a ground surface and to cut into said ground surface, the scarifier machine comprising at least one pair of wheels providing the scarifier machine with rolling mobility relative to the ground surface; and a guide system for guiding the scarifier machine on a tracked trail along said ground surface, the guide system comprising one or more guide rails, each guide rail comprising a first portion attachable to said ground surface and a second portion arranged at a 90-degree angle with the first portion such that said each guide rail has an L-shaped transverse cross-section; and at least one guide rail receiver carried by the scarifier machine, wherein each guide rail receiver comprises a first roller and a second roller arranged in spaced-apart relationship with one another; wherein the scarifier system is configured to adopt an assembled configuration in which the first portion of one guide rail of the one or more guide rails is attached to the ground surface, and the second portion of said one guide rail is arranged rising vertically upward from the ground surface, and further wherein the first and second rollers of each guide rail receiver are arranged on opposite side surfaces of the second portion of said one guide rail and are rollingly movable on said opposite side surfaces and along said one guide rail responsively to the scarifier machine being operated to travel along the ground surface, without said each guide rail receiver being supported on said one guide rail, and further wherein the first and second rollers of said each guide rail receiver are free to adjust their vertical position relative to the second portion of said one guide rail both upward and downward.

* * * * *